US007612982B2

(12) United States Patent
Pishdadian

(10) Patent No.: US 7,612,982 B2
(45) Date of Patent: Nov. 3, 2009

(54) PULSED HIGH VOLTAGE IGNITER CIRCUIT

(75) Inventor: Hamid Pishdadian, Warwick, RI (US)

(73) Assignee: Kaz, Incorporated, Southborough, MA (US)

( * ) Notice: Subject to any disclaimer, the term of this patent is extended or adjusted under 35 U.S.C. 154(b) by 0 days.

(21) Appl. No.: 12/058,510

(22) Filed: Mar. 28, 2008

(65) Prior Publication Data

US 2008/0239615 A1 Oct. 2, 2008

Related U.S. Application Data

(60) Provisional application No. 60/909,392, filed on Mar. 30, 2007.

(51) Int. Cl.
*F23Q 3/00* (2006.01)
*F23Q 5/00* (2006.01)

(52) U.S. Cl. ..... 361/254; 361/256

(58) Field of Classification Search ..... 361/268, 361/254, 256
See application file for complete search history.

(56) References Cited

U.S. PATENT DOCUMENTS 3,726,630 A * 4/1973 Potts ..... 431/78
3,746,920 A * 7/1973 Flatley ..... 315/170
3,795,843 A 3/1974 Ishida et al.
3,906,919 A 9/1975 Asik et al.
5,068,570 A * 11/1991 Oda et al. ..... 315/128

* cited by examiner

*Primary Examiner*—Ronald W Leja
(74) *Attorney, Agent, or Firm*—Darby & Darby P.C.; Matthew M. Gaffney

(57) ABSTRACT

A high voltage generator circuit is provided. The high voltage generator circuit can generate a high voltage suitable for use with an igniter. While generating the required high voltage, the circuit results in a significantly reduced amount of electrical noise such that the disruption of adjacent, sensitive circuitry is minimized. More specifically, the circuit periodically generates a high voltage on an inductor and causes the high voltage generated to incrementally charge up and build up the voltage on a capacitor connected to the inductor. The capacitor is isolated from the adjacent, sensitive circuitry by way of a relay. Also, to minimize the number of components and complexity of the high voltage generator circuit, the inductor which is used to generate the high voltage is the inductor located within the relay, which is also used to switch the contacts of the relay.

20 Claims, 2 Drawing Sheets

PULSED HIGH VOLTAGE IGNITER CIRCUIT

CROSS-REFERENCE TO RELATED APPLICATION

This application claims the benefit of U.S. Provisional Patent Application 60/909,392 filed Mar. 30, 2007, the benefit of the earlier filing date of which is hereby claimed under 35 U.S.C. §119(e) and which is further incorporated by reference.

FIELD OF THE INVENTION

The present invention generally relates to high voltage generator circuits, and more specifically, but not exclusively, to a pulsed, high voltage generator circuit used to provide a spark for igniting a combustible gas.

BACKGROUND OF THE INVENTION

High voltage generator circuits are used for many different applications, including lighting applications and igniter circuits as just a few examples. In the case of igniter circuits, the voltage generated must be sufficiently high in order to cause electrical breakdown of air and create a spark. Since the breakdown voltage of air is typically 30 kV per centimeter, a voltage of several thousand volts or even tens of thousands of volts may be needed to create a spark across a gap on the order of a centimeter or less.

For most igniter circuits, the high voltage needed to create the breakdown or spark is generated from a low voltage power source, since most power sources are of relatively low voltage, on the order of tens of volts. One method of producing a high voltage from a low voltage source is to incrementally build up the high voltage on a temporary charge or voltage storing component, such as a capacitor. A switching circuit is utilized in conjunction with the voltage source and the capacitor.

A common problem associated with such switching circuits used to generate high voltage for igniter circuits is that they generate electrical noise in the circuit due to the switching involved, and since the switching involves high voltages, the voltage and/or power of the electrical noise generated is unnecessarily high. This may impact the operation of other circuitry located nearby or on the same circuit board. Additionally, the problem is especially significant when the adjacent circuitry is sensitive high speed electronic circuitry. A typical example of how to cope with this electrical noise is to physically separate the spark generator from the rest of the electronics, frequently by placing it on a different PCB, which adds cost and complexity.

Thus, there is a need for a high voltage generator circuit which is able to generate high voltage, such as that used in igniter circuits, but without causing unnecessary electrical noise or disturbance for adjacently located electronic circuitry.

SUMMARY OF THE INVENTION

The present invention is related to a high voltage generator circuit which can generate a high voltage suitable for use with an igniter. While generating the required high voltage, the circuit results in a significantly reduced amount of electrical noise such that the disruption of adjacent, sensitive circuitry is minimized.

Specifically, at least one embodiment of the present invention periodically generates a high voltage on an inductor and causes the high voltage generated to incrementally charge up and build up the voltage on a capacitor connected to the inductor. The capacitor is isolated from the adjacent, sensitive circuitry by way of a relay. Also, to minimize the number of components and complexity of the high voltage generator circuit, the inductor which is used to generate the high voltage is the inductor located within the relay, which is also used to switch the contacts of the relay.

DESCRIPTION OF THE DRAWINGS

These and other objects and features of the invention will become more apparent by referring to the drawings, in which.

DETAILED DESCRIPTION OF A PREFERRED EMBODIMENT

Figure 1:
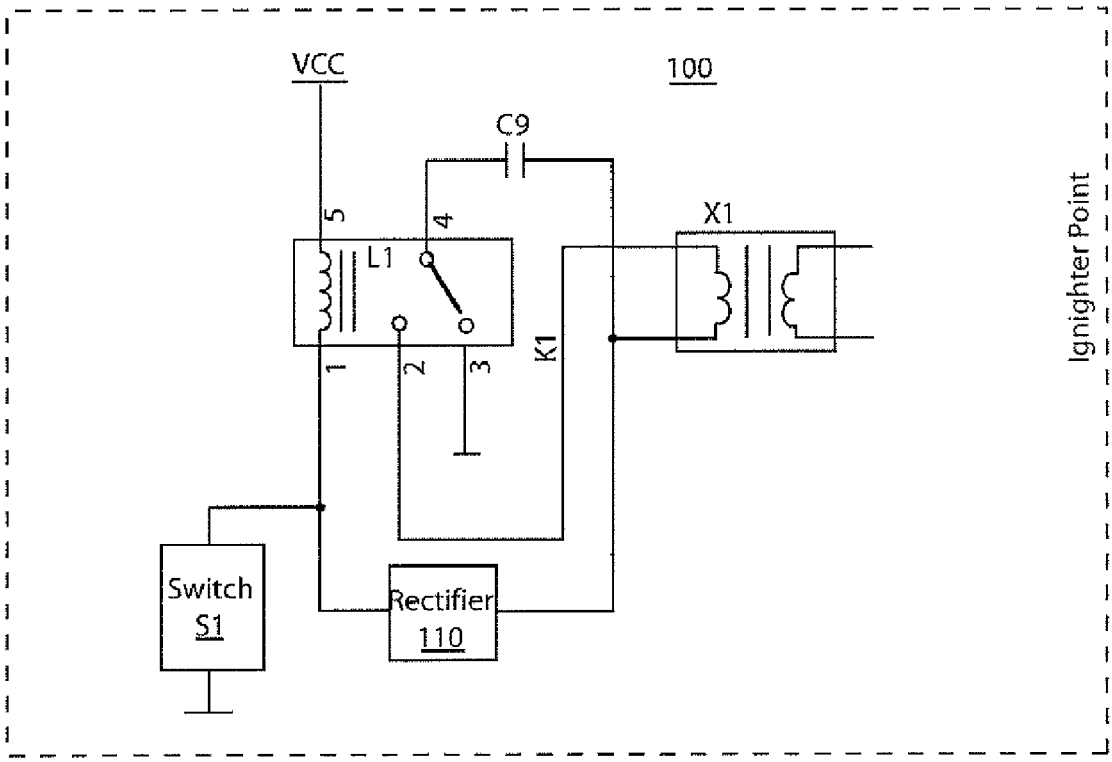
FIG. 1 is a block diagram of a high voltage generator circuit according to an embodiment of the present invention.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. Similarly, the phrase "in some embodiments," as used herein, when used multiple times, does not necessarily refer to the same embodiments, although it may. As used herein, the term "or" is an inclusive "or" operator, and is equivalent to the term "and/or," unless the context clearly dictates otherwise. The term "based, in part, on", "based, at least in part, on", or "based on" is not exclusive and allows for being based on additional factors not described, unless the context clearly dictates otherwise. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data, or other signal. Where either a field effect transistor (FET) or a bipolar junction transistor (BJT) may be employed as an embodiment of a transistor, the scope of the words "gate", "drain", and "source" includes "base", "collector", and "emitter", respectively, and vice versa.

FIG. 1 illustrates a block diagram of circuit 100, which may be employed as a high voltage generator circuit. Circuit 100 includes relay K1, switch S1, rectifier 110, capacitor C9, and transformer X1. Relay K1 has five contacts (numbered 1, 2, 3, 4, and 5 in the example illustrated in FIG. 1), and includes inductor L1.

In operation, switch S1 is turned on and off, for example, at a frequency on the order of 30 Hz. The exact frequency may be dependent on both the supply voltage and response time of the relay. The pulsing frequency, as well as the ON time of the cycle, is sufficiently timed such that relay K1 is not tripped. Switch S1 is coupled between contact 1 of the relay and a reference voltage—the reference voltage may be ground, VSS, some other fixed DC voltage, or the like.

As switch S1 is turned on and off at a periodic rate on the order of 30 Hz, relay K1 is untripped. While relay K1 is untripped, it provides a connection between contact 4 and contact 3 of relay K1. As explained in greater detail below, while switch S1 is turned on and off at a periodic rate on the order of about 30 Hz, a large voltage builds up on capacitor C9.

Once a sufficient voltage has been built up on capacitor C9, switch S1 is turned ON for a sufficiently long period of time to trip relay K1 (instead of turning on and off at a period rate of about 30 Hz, as it did prior to capacitor C9 reaching the target voltage). When relay K1 is tripped, relay K1 provides a connection between contact 4 and contact 2 of the relay (instead of between contact 4 and contact 3). This causes capacitor C9 (and the voltage across capacitor C9) to be presented at the primary side of the igniter transformer X1. In turn, this causes a high voltage to be presented at the secondary side of transformer X1 (the voltage multiplication from primary to secondary dependent on the relative number of turns of the primary and secondary windings of transformer X1).

In various embodiments, determining when the voltage across capacitor C9 has reached the target voltage may be accomplished in different ways in different embodiments. In one embodiment, circuit 100 includes a clock in the software that determines both the build up and the number of clock cycles. The known component values are used to estimate when the target voltage is reached. These embodiments and others are within the scope and spirit of the invention.

Figure 2:
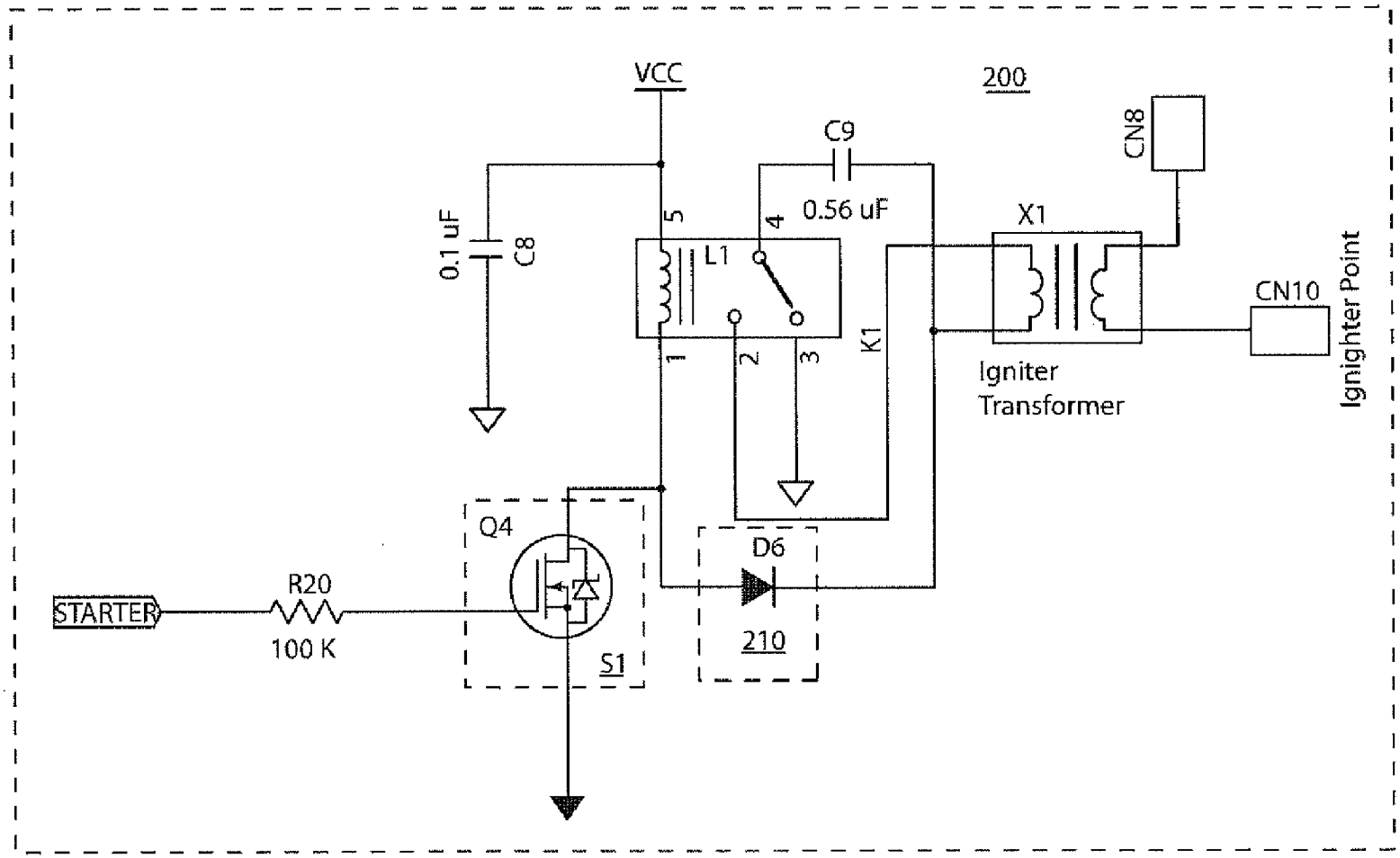
FIG. 2 is an electrical schematic of an embodiment of the high voltage generator circuit of FIG. 1 according to aspects of the present invention.

Referring now to FIG. 2, therein is illustrated an electrical schematic of a high voltage generator circuit 200, which may be employed as an embodiment of circuit 100 of FIG. 1. Circuit 200 further includes capacitor C8 and resistor R20. Switch S1 includes transistor Q4. Rectifier 210 includes diode D6.

In operation, transistor Q4 is pulsed ON and OFF, for example, at a frequency on the order of 30 Hz. The exact frequency is dependent on both the supply voltage and response time of the relay. The pulsing frequency, as well as the ON time of the cycle, is sufficiently timed such that relay K1 is not tripped. Relay K1 includes an inductor, which has one side connected to a typical voltage supply, for example, +5V, or +12V. The voltage, VCC provided at one side of the inductor may be provided by a DC power supply circuit (not shown). The other side of the coil within relay K1 is connected to the drain of transistor Q4 when Q4 is implemented as an N-channel FET (Field Effect Transistor). Alternatively, if transistor Q4 is a bipolar junction transistor, then the coil would be connected to the collector of the transistor.

Each time that transistor Q4 is turned OFF and caused to cease conducting, an extremely high voltage is developed at the coil within the relay K1 due to the transient effect of the flow of current through the coil, i.e., the energy stored within the coil creates a high voltage at one end of the coil. This high voltage is passed through diode D6 and onto capacitor C9 where it causes charge (and correspondingly voltage) to accumulate on capacitor C9. Diode D6 prevents capacitor C9 from discharging or losing its charge. For each cycle, transistor Q4 is turned OFF to cause voltage to build up on capacitor C9, and then caused to turn ON, to set up the transient high voltage effect for the next cycle when transistor Q4 turns off. In this way, the voltage built up on capacitor C9 can be controlled based on the number of ON/OFF cycles of transistor Q4.

Once a sufficient voltage has been built up on capacitor C9, transistor Q4 is turned ON for a sufficiently long period of time to trip relay K1. This causes capacitor C9 (and the voltage across capacitor C9) to be presented at the primary side of the igniter transformer X1. In turn, this causes a high voltage to be presented at the secondary side of transformer X1 (the voltage multiplication from primary to secondary dependent on the relative number of turns of the primary and secondary windings of transformer X1).

One advantage of circuit 200 is that the high voltage circuit (capacitor C9 and transformer X1) is isolated from the rest of the circuit, by way of relay K1. This helps in reducing the unwanted effects of electrical noise on the rest of the circuitry.

Another advantage of circuit 200 is that the coil inside relay K1 is used for two different purposes. One purpose is to assist in the tripping or switching of the relay. Another purpose is to create the transient high voltage which is used to charge the capacitor.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A circuit for voltage generation, comprising:

a relay that includes an inductor, wherein the inductor is coupled between a first node and a second node, the relay provides a connection between a third node and a fourth node if the relay is not tripped, and wherein the relay provides a connection between the third node and a fifth node if the relay is tripped;

a switch that is coupled between the second node and a reference voltage node;

a rectifier that is coupled between the second node and a sixth node;

a first capacitor that is coupled between the sixth node and the third node; and a transformer, including:

a primary winding that is coupled between the sixth node and the fifth node, wherein the inductor is coupled between a power supply node and the switch.

2. The circuit of claim 1, further comprising a DC power supply having at least an output that is coupled to the first node.

3. The circuit of claim 1, wherein the reference voltage node is a ground node.

4. The circuit of claim 1, wherein the transformer further includes a secondary winding that operates as an igniter.

5. A circuit for voltage generation, comprising:

a relay that includes an inductor, wherein the inductor is coupled between a first node and a second node, the relay provides a connection between a third node and a fourth node if the relay is not tripped, and wherein the relay provides a connection between the third node and a fifth node if the relay is tripped;

a switch that is coupled between the second node and a reference voltage node;

a rectifier that is coupled between the second node and a sixth node;

a first capacitor that is coupled between the sixth node and the third node; and a transformer, including:

a primary winding that is coupled between the sixth node and the fifth node, wherein the relay is arranged such that the relay isolates the transformer from switching noise associated with the switch.

6. The circuit of claim 1, wherein the first capacitor has a capacitance of at least .1 microFarad.

7. The circuit of claim 1, wherein the rectifier is a diode.

8. The circuit of claim 7, wherein the diode has an anode that is coupled to the second node and a cathode that is coupled to the sixth node.

9. A circuit for voltage generation, comprising:

a relay that includes an inductor, wherein the inductor is coupled between a first node and a second node, the relay provides a connection between a third node and a fourth node if the relay is not tripped, and wherein the relay provides a connection between the third node and a fifth node if the relay is tripped;

a switch that is coupled between the second node and a reference voltage node;

a rectifier that is coupled between the second node and a sixth node;

a first capacitor that is coupled between the sixth node and the third node; and a transformer, including:

a primary winding that is coupled between the sixth node and the fifth node, wherein the switch is operable to turn on and off at a periodic rate that does not trip the relay until the voltage across the capacitor reaches a target voltage, and to turn on for a sufficient length of time to trip the relay when the voltage across the capacitor reaches the target voltage.

10. The circuit of claim 9, wherein the periodic rate is on the order of 30 Hertz.

11. The circuit of claim 1, wherein the circuit is arranged such that the relay is not tripped if a voltage across the capacitor is below a target voltage, and such that the relay is tripped when the voltage across the capacitor reaches a target voltage.

12. The circuit of claim 11, wherein the target voltage is at least 1000 Volts.

13. A circuit for voltage generation, comprising:

a relay having at least a first contact, a second contact, a third contact, and an inductor, wherein the relay is arranged to couple the first contact to the second contact if the relay is not tripped, and to couple the first contact to the third contact if the relay is tripped;

a capacitor that is coupled to the first contact of the relay;

a switch that is coupled between the inductor and a reference voltage, wherein the switch is arranged to open and close at a periodic rate wherein the periodic rate is such that the relay is not tripped as long as a voltage across the capacitor is below a target voltage, and wherein the switch is further arranged to trip the relay when the voltage across the capacitor reaches the target voltage;

a rectifier that is coupled between the switch and the capacitor; and a transformer having a primary winding that is coupled between the capacitor and the third contact of the relay.

14. The circuit of claim 13, wherein the rectifier is a diode.

15. The circuit of claim 13, wherein the reference voltage node is a ground node, and wherein the second contact of the relay is coupled to the ground node.

16. The circuit of claim 13, wherein the inductor is coupled between a power supply node and the switch.

17. The circuit of claim 16, further comprising a DC power supply circuit that is arranged to provide a DC voltage at the power supply node.

18. A method for voltage generation, comprising:

opening and closing a switch at a periodic rate, wherein the switch is coupled between a first node and a reference voltage node, the first node is coupled to an inductor of a relay, and wherein the periodic rate is such that the relay is not tripped;

coupling the first node to a second node, wherein a capacitor is coupled between the second node and a third node, and wherein the relay is coupled to the third node;

when a voltage across the capacitor reaches a target voltage, ceasing the opening and closing of the switch at the periodic rate, and closing the switch for a sufficient duration of time that the relay is tripped; and employing the voltage across the capacitor to ignite a spark.

19. The method of claim 18, wherein coupling the first node to the second node is accomplished with a diode.

20. The method of claim 18, wherein employing the voltage across the capacitor to ignite a spark is accomplished, in part, with a transformer having a primary winding that is coupled to the capacitor.

* * * * *